US008099896B2

(12) United States Patent
Paasikivi et al.

(10) Patent No.: US 8,099,896 B2
(45) Date of Patent: Jan. 24, 2012

(54) RIFLE HAVING A REPLACEABLE BARREL

(75) Inventors: Henry Paasikivi, Helsinki (FI); Juha Aalto, Riihimaki (FI)

(73) Assignee: Sako Oy, Riihimaki (FI)

( * ) Notice: Subject to any disclaimer, the term of this patent is extended or adjusted under 35 U.S.C. 154(b) by 0 days.

(21) Appl. No.: 11/631,662

(22) PCT Filed: Jul. 7, 2005

(86) PCT No.: PCT/FI2005/050272

§ 371 (c)(1),
(2), (4) Date: Dec. 19, 2007

(87) PCT Pub. No.: WO2006/018479

PCT Pub. Date: Feb. 23, 2006

(65) Prior Publication Data

US 2008/0178510 A1 Jul. 31, 2008

(30) Foreign Application Priority Data

Jul. 7, 2004 (FI) ..... 20040947

(51) Int. Cl.
*F41A 21/00* (2006.01)

(52) U.S. Cl. ..... 42/77; 42/75.01; 42/75.02; 42/75.03; 102/430

(58) Field of Classification Search ..... 42/77
See application file for complete search history.

(56) References Cited

U.S. PATENT DOCUMENTS

| | | | | |
|---|---|---|---|---|
| 3,849,925 | A | 11/1974 | Mayer | |
| 4,220,071 | A * | 9/1980 | Seiderman | 89/128 |
| 5,513,550 | A * | 5/1996 | Field | 89/163 |
| 5,557,871 | A * | 9/1996 | LaLonde | 42/95 |
| 5,737,865 | A * | 4/1998 | Brandl et al. | 42/75.02 |
| 5,765,302 | A * | 6/1998 | Brandl et al. | 42/18 |
| 5,906,066 | A * | 5/1999 | Felk | 42/69.02 |
| 5,987,797 | A * | 11/1999 | Dustin | 42/75.02 |
| 6,212,814 | B1 * | 4/2001 | Lambie | 42/75.03 |
| 6,823,857 | B2 * | 11/2004 | Perry et al. | 124/84 |
| 6,848,208 | B1 * | 2/2005 | Kirschner | 42/77 |
| 7,000,345 | B1 * | 2/2006 | Kay | 42/75.02 |
| 7,131,228 | B2 * | 11/2006 | Hochstrate et al. | 42/75.01 |
| 7,444,775 | B1 * | 11/2008 | Schuetz | 42/76.01 |
| 7,451,564 | B2 * | 11/2008 | Wait | 42/75.02 |
| 2002/0178959 | A1 * | 12/2002 | Rennard | 102/430 |
| 2005/0045056 | A1 * | 3/2005 | EkenediliChukwu | 102/430 |
| 2005/0091901 | A1 * | 5/2005 | Perry et al. | 42/78 |
| 2007/0277669 | A1 * | 12/2007 | Tertin | 89/128 |
| 2009/0019755 | A1 * | 1/2009 | Moretti | 42/75.01 |

FOREIGN PATENT DOCUMENTS

| | | |
|---|---|---|
| EP | 1398594 | 3/2004 |
| FI | 20040200 | 8/2005 |
| GB | 703188 | 1/1954 |

* cited by examiner

*Primary Examiner* — Michael Carone
*Assistant Examiner* — Samir Abdosh
(74) *Attorney, Agent, or Firm* — Alfred A. Fressola; Ware, Fressola, Van Der Sluys & Adolphson LLP

(57) ABSTRACT

A rifle with a replaceable barrel with two or more barrels for different purposes and calibers and with own magazines for different cartridges. At least one barrel (1) has the cavity (2), into which a projection or upper edge (4) in the cartridge magazine (3) corresponding to the barrel fits, when the right magazine has been inserted into the rifle.

8 Claims, 1 Drawing Sheet

RIFLE HAVING A REPLACEABLE BARREL

CROSS REFERENCE TO RELATED APPLICATIONS

This application is for entry into the U.S. national phase under §371 for International Application No. PCT/FI05/050272 having an international filing date of Jul. 7, 2005, and from which priority is claimed under all applicable sections of Title 35 of the United States Code including, but not limited to, Sections 120, 363 and 365(c), and which in turn claims priority under 35 USC §119 to Finnish Patent Application No. 20040947 filed on Jul. 7, 2004.

TECHNICAL FIELD

The invention relates to a rifle with a replaceable barrel with two or more barrels for different purposes and calibers and with its own magazines for different cartridges.

BACKGROUND OF THE INVENTION

Such a fastening system for a rifle with a replaceable barrel known as such has been disclosed in the patent specification FI-20040200. It has been stated that it is possible to load a rifle by accident, for example, with a .22 LR caliber cartridge, although the rifle has a barrel for a .17 HMR (Hornady Magnum Rifle) cartridge, the diameter of which is approximately 1 mm smaller than the diameter of the barrel for the .22 LR cartridges. Test shots have been fired using a .22 LR cartridge in a rifle having the barrel for a .17 HMR cartridge and it has been noted that a lead bullet will compress so much that it will pass through the barrel, and does not cause any danger.

SUMMARY OF THE INVENTION

The purpose of the invention is to prevent such a mistake and a possible theoretical accident. It is characteristic of a rifle with a replaceable barrel according to the invention that at least one barrel has a cavity into which a projection or upper edge in the cartridge magazine corresponding to the barrel fits, when the correct magazine has been inserted into the rifle. Thus, it is possible to prevent an incorrect magazine and thus also an incorrect cartridge from getting into a barrel, which is of a smaller caliber than the cartridge.

It is characteristic of an embodiment of the invention, in which replaceable barrels of three different calibers are used for .22 LR (long rifle), .22 Win Mag. (Winchester Magnum) and .17 HMR (Hornady Magnum Rifle) cartridges that the replaceable barrel .22 LR has a cavity, into which the upper edge of a corresponding .22 LR cartridge magazine fits, as the magazine has been inserted into the rifle. The calibers are those of a so-called small-bore rifle, and after the new .17 HMR caliber in rifles with replaceable barrels was introduced, it has been noted that there is a risk that it is possible to load the rifle with a cartridge, the caliber of which is .22, i.e. with a diameter of 5.6 mm, when again the rifle may have a barrel with a caliber of .17, i.e. a diameter of 4.3 mm. By means of the invention a cartridge magazine, which is not intended for a .17-caliber barrel, will simply not fit the rifle with the said barrel.

It is characteristic of a second embodiment of the invention that the replaceable barrels have a code, such as a colour ribbon encircling the base of the barrel, and that the rifle stock has equivalent codes with markings indicating which colour corresponds to which caliber. The user or buyer of the rifle can already see in the rifle rack that an orange colour ribbon around the barrel tells that the rifle concerns a "SAKO" rifle and that the equivalent orange colour spot in the stock with the marking .22 LR indicates that the barrel of the rifle is intended for a cartridge with the .22 LR caliber.

If and when the cartridge magazine still has the same code, it can be insured that the correct cartridge magazine is used, into which the correct cartridges intended for the magazine fit.

BRIEF DESCRIPTION OF THE DRAWINGS

The invention will next be described by means of an example, referring to the enclosed drawings, in which.

DETAILED DESCRIPTION

Figure 3:
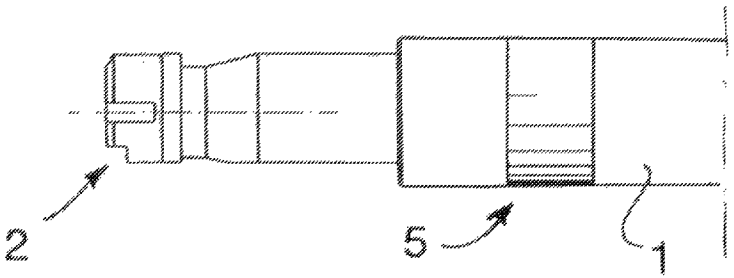
FIG. 3 shows the locking head of a replaceable barrel.
Figure 2:
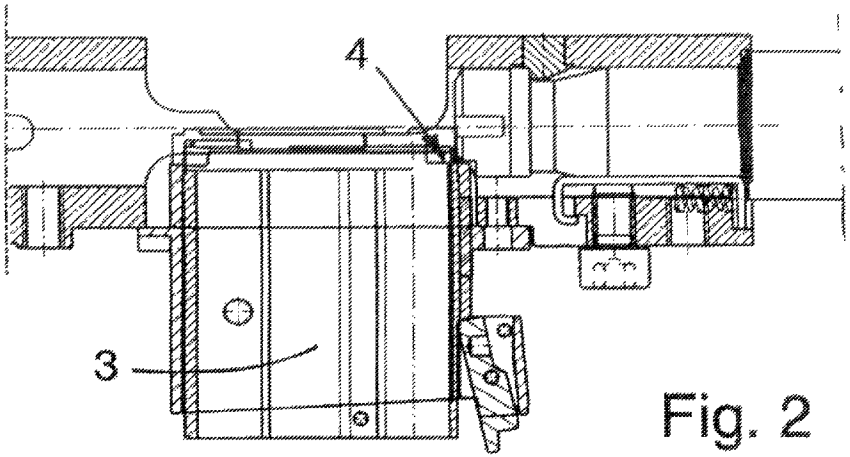
FIG. 2 shows a part in the lock casing of the rifle in sectional view.
Figure 1:
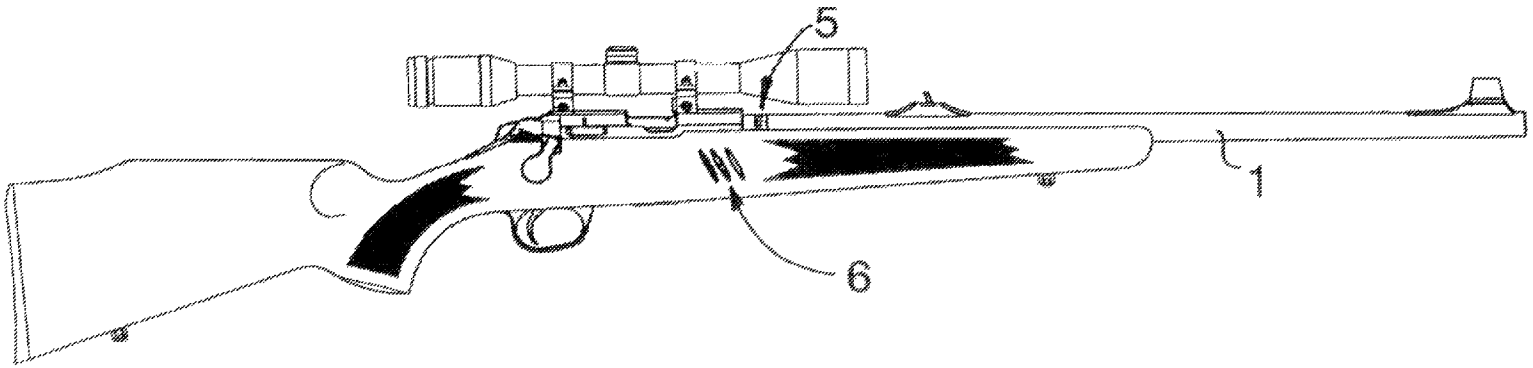
FIG. 1 shows a rifle with a replaceable barrel, i.e. a small-bore rifle provided with a riflescope.

Three replaceable barrels of different calibers are used in a rifle with replaceable barrels for .22 LR (long rifle), .22 Winchester Magnum and .17 HMR cartridges. The .22 LR replaceable barrel 1 has a cavity 2, into which the upper edge 4 of the cartridge magazine 3 for the respective .22 LR cartridge magazine fits, when the magazine has been inserted into the rifle. If the rifle has a .17-caliber barrel without the notch 2, and one tries to insert a .22 LR or .22 Winchester Magnum cartridge magazine, this will not be successful, because the edge of the magazine will in this situation contact the edge of the barrel with no cavity.

The replaceable barrels of a rifle with a replaceable barrel have the colour codes 5 and the stock of the rifle has the equivalent colour codes 6 with the markings .22 LR, .22 Win Mag. and .17 HMR, indicating which caliber barrel is attached to the rifle. If the magazine still has the colour code, it is also avoided that a magazine with another colour code will be pushed into the rifle by accident, since the barrel has a different colour code.

What is claimed is:

1. A rifle comprising a replaceable barrel with two or more barrels for different purposes and calibers and with its own cartridge magazines for different cartridges, wherein at least one barrel has a cavity, into which a projection or upper edge in a cartridge magazine corresponding to one of the barrels fits, when a correct cartridge magazine corresponding to said one of the barrels has been inserted into the rifle, and a second cartridge magazine for a second caliber, which is not intended for said at least one barrel, will not fit the rifle with said at least one barrel and thus preventing an incorrect cartridge from said second cartridge magazine from getting into said at least one barrel.

2. The rifle with a replaceable barrel according to claim 1, in which three replaceable barrels of different calibers are used for .22 LR, .22 Win Mag., and .17 HMR cartridges, wherein the replaceable barrel .22 LR has the cavity, into which the upper edge of the equivalent .22 LR cartridge magazine fits, when the cartridge magazine has been inserted into the rifle.

3. The rifle with a replaceable barrel according to claim 2, wherein the replaceable barrels have a code, and that a stock of the rifle has equivalent colour codes with markings indicating which colour corresponds to which caliber.

4. The rifle with a replaceable barrel according to claim 3, wherein the cartridge magazine has a respective code.

5. The rifle with a replaceable barrel according to claim 3, wherein the code of each replaceable barrel is a colour ribbon encircling the base of the replaceable barrel.

6. The rifle with a replaceable barrel according to claim 1, wherein the replaceable barrels have a code, and that a stock of the rifle has equivalent colour codes with markings indicating which colour corresponds to which caliber.

7. The rifle with a replaceable barrel according to claim 6, wherein the cartridge magazine has a respective code.

8. The rifle with a replaceable barrel according to claim 6, wherein the code of each replaceable barrel is a colour ribbon encircling the base of the replaceable barrel.

* * * * *